United States Patent [19]

Prähauser et al.

[11] 4,238,254

[45] Dec. 9, 1980

[54] PYROTECHNIC SMOKE CHARGE CONTAINING GUANIDINE NITRATE

[75] Inventors: Georg Prähauser, Oberalm, Austria; Alois Schiessl, Marzoll, Fed. Rep. of Germany

[73] Assignee: Buck Chemisch-Technische Werke GmbH & Co., Reichenhall, Fed. Rep. of Germany

[21] Appl. No.: 36,423

[22] Filed: May 7, 1979

[30] Foreign Application Priority Data

May 5, 1978 [DE] Fed. Rep. of Germany ..... 2819850

[51] Int. Cl.[3] ..... C06B 39/00

[52] U.S. Cl. ..... 149/29; 149/87; 149/92

[58] Field of Search ..... 149/29, 87, 92

[56] References Cited

U.S. PATENT DOCUMENTS 3,607,472 9/1971 Douda ..... 149/29 X

*Primary Examiner*—Stephen J. Lechert, Jr.

*Attorney, Agent, or Firm*—Oblon, Fisher, Spivak, McClelland & Maier

[57] ABSTRACT

A pyrotechnic smoke charge which comprises guanidinium nitrate and (a) chlorohydrocarbons and a metal powder, of (b) red phosphorous, which can be partially replaced by a chlorohydrocarbon, and wherein said charge may optionally contain a small amount of a reaction regulating agent.

12 Claims, No Drawings

PYROTECHNIC SMOKE CHARGE CONTAINING GUANIDINE NITRATE

BACKGROUND OF THE INVENTION

1. Field of the Invention

The present invention relates to pyrotechnic smoke charges containing guanidine nitrate.

2. Description of the Prior Art

The theory and techniques of natural fog formation, and in particular of artificial fog generation, are discussed briefly and broadly in TECHNIK und VERSORGUNG 1970, pp. 63 to 68. Together with the most varied agents and methods for production of artificial fog or smoke, viz. for camouflage, there are also described on pages 65 to 67 under the group of pyrotechnic fogs, chlorohydrocarbon-metal and phosphorus smoke charges. A special form of chlorohydrocarbon-metal smoke charges are those containing zinc dust as the metal, where a portion of this zinc dust may be replaced by zinc oxide and small quantities of other metal powders as reaction accelerators, e.g. aluminium powder, are present. Such smoke charges are also disclosed in GB-PS No. 127031 and Dr. H. Ellem's Modern Pyrothechnics, 1961, p. 277. Hexachlorethane is normally preferred as the chlorohydrocarbon. Along with powdered zinc and possibly zinc oxide powder such smoke charges may contain in addition to, or instead of aluminium powder, small amounts of powdery silicon, titanium, iron and/or magnesium, where possibly there may be present, moreover, even small quantities of ordinary metal-oxide powders, like powdery manganese dioxide, copper oxide or iron oxide. The phosphorus smoke charges contain along with red phosphorus, as a rule, additional constituents such as powdered metal, e.g. magnesium powder; metal oxides, like manganese dioxides or especially copper oxide, or even nitrates, like potassium nitrate or barium nitrate.

DE-PS No. 887 128 discloses a fumigant for combating vermin consisting of a volatilizing pesticide compound together with guanidine nitrate and a substance promoting the exothermic decomposition of guanidine nitrate wherein the decomposition-accelerating substance is a polynitrophenol or a polynitrosophenol. Exemplary agents of this type contain a preponderant amount of guanidine nitrate (67 or 65%), 4, 6-dinitro-o-cresol or dinitroresorcinal (18 or 15%) of pesticide, and $\alpha,\alpha$-bis (p-chlorophenyl) $\beta$, $\beta$, $\beta$-trichlorethane or $\gamma$-hexachlorocyclohexane (15 or 20%). By the use of chlorohydrocarbons a high output of smoke is apparently achieved. Nothing is said about the purpose of the guanidine nitrate present in this fumigant, but by its use there should obviously be effected through the gases arising from its thermal decomposition a volatilization of the other components. Metal powders and other constituents customary in pyrotechnic smoke charges are necessarily absent from this fumigant and the latter would not be suitable as a smoke charge if only because of its toxicity.

The above discussed pyrotechnic smoke charge based on chlorohydrocarbons, in particular hexachlorethane, and metal powder, in particular zinc powder, or based on red phosphorus, though distinguished by sufficiently high smoke output with good screening power, still have the drawback that they are not nontoxic to the desired degree. During screening with such smoke charges there is indeed produced hydrogen chloride or phosphorus pentoxide which can lead to severe toxic symptoms when inhaled. There have even been fatalities from this, particularly when such smoke charges were set off in more or less confined spaces and/or under conditions of too low humidity. Since a smoke, however, serves exclusively for purposes of camouflaging it must be basically nontoxic. This requirement is not fulfilled by smoke charges based on chlorohydrocarbons and powdered metal on account of the hydrogen chloride generated by them, and the same is true to a somewhat smaller degree in the case of smoke charges based on red phosphorus, in the volatilization of which phosphorus pentoxide is formed.

SUMMARY OF THE INVENTION

The invention thus has the problem of modifying the above discussed known smoke charges based on chlorohydrocarbon and metal powder or on phosphorus so that they are no longer toxic, while affording at least as good or even improved smoke output, with of course no significant adverse effect on the cost.

These and other objects of the invention, as will hereinafter become more readily apparent, have been attained by providing a smoke charge which comprises guanidine nitrate and (a) chlorohydrocarbons and a metal powder or (b) red phosphorous, which can be partially replaced by a chlorohydrocarbon, and wherein said charge optionally contains a small amount of a customary reaction regulating agent.

DESCRIPTION OF THE PREFERRED EMBODIMENTS

The guanidine nitrate used for this purpose has the formula

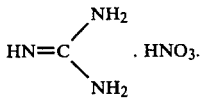

It is chiefly remarkable for being an energy-rich and oxygen-containing compound which, in the course of the smoke-generating reaction, acts exothermically, supplying heat to the reaction, and at the same time gives off decomposition products which neutralize the acids (hydrochloric and phosphoric acids) liberated in volatilizing smoke charges of the type considered. These substances thus can no longer exert their toxic effect so that the resulting smoke is nontoxic with respect to its acid content. The fact that guanidine nitrate is not only an agent neutralizing liberated acids, but also an energy-supplying one, necessarily entails the extremely desirable consequence that by its use there is generally no need for the otherwise unavoidable addition to such smoke charges of reaction accelerators. Among such accelerators are chiefly energy-rich metal powders, particularly powdered aluminum or magnesium, or for example also energy-rich metal oxide powders or other oxygen sources. In certain cases such guanidine nitrate-containing pyrotechnic smoke charges of the invention can, if desired, also contain such customary agents in small amounts. The only essential is the presence of sufficient guanidine nitrate for the stated purpose. The smoke charge of the invention can thus consist of either only a suitable chlorohydrocarbon, metal powder and guanidine nitrate or only red phosphorus and guanidine nitrate in the proper proportions for the desired purpose in either case. All other additives of technical relevance are not absolutely required and are possibilities of minor significance with regard to amount or effect.

A preferred form or embodiment of a pyrotechnic smoke charge of the invention is based on (a) a chlorohydrocarbon and a metal powder and contains guanidine nitrate as reaction accelerator.

As metal powder there can be used zinc powder, aluminium powder, titanium powder or silicon powder, with zinc powder being especially preferred. The use of the other just-mentioned metal powders generally results in such high heat of reaction that the guanidine nitrate serving as neutralizing agent is destroyed without formation of the ammonia necessary for the neutralization. Therefore in utilizing such metal powders one must establish the reaction temperature required for the neutralization reaction by the addition of suitable agents, and for this the best suited is zinc oxide or titanium dioxide.

As chlorohydrocarbons there may be utilized here, in principle, all the customary ones in such smoke charges, e.g. saturated aliphatic chlorohydrocarbons like dichloromethane, carbon tetrachloride, trichloroethylene, tetrachlorethane or hexachloroethane, or even aromatic chlorohydrocarbons like pentachlorobenzene or hexachlorobenzene. Carbon tetrachloride and hexachloroethane are preferred among these, hexachloroethane is particularly preferred.

The amount of chlorohydrocarbon ranges in general, (referred to the formation of metal chloride from whatever metal is present) from about the stoichiometrically required amount to about a 15% excess.

The guanidine nitrate generally amounts to at least about a mole of guanidinium nitrate per three chlorine atoms in the chlorohydrocarbon. A certain portion of the metal powder, for example powdered zinc, can also be replaced by reaction-moderating metal-oxide powder, e.g. zinc oxide powder, whereby the reaction time can be controlled. In general, up to 40 wt.% of the zinc dust can be replaced by zinc oxide. Preferably 10 to 40 wt.%, and in particular 20 to 30 wt.%, of the zinc dust is replaced by zinc oxide. The zinc oxide can also be completely or partially replaced by other metal-oxide powders, e.g. copper oxide, iron oxide, manganese dioxide or titanium dioxide. Together with powdered zinc there can also be present small quantities of other customary metal powders, e.g. powdered silicon, titanium, aluminium, iron or magnesium and their alloys.

The guanidine nitrate generally amounts to about 36 to 46 wt.% of the entire smoke charge. It lies preferably at about 31 to 41 wt.%, and amounts particularly to about 36 wt.%.

An especially preferred smoke charge based on chlorohydrocarbons and metal powder contains about 34 wt. % hexachloroethane, about 22 wt.% powdered zinc, about 8 wt.% zinc oxide and about 36 wt.% guanidine nitrate.

A further example of one embodiment of the invention is a pyrotechnic smoke charge based on (b) red phosphorus and also containing guanidine nitrate. In general there is, together with red phosphorus, a balance of about 30 to 50 wt.% guanidine nitrate, preferably about 35 to 45 wt.% guanidine nitrate, and in particular about 40 wt.% guanidine nitrate. Smoke charges of this type can possibly also contain common binders, e.g. in an amount of up to about 25 wt.%.

Together with the components, i.e. red phosphorus and guanidine nitrate, absolutely required in such a smoke charge, there can still be present, just as in the smoke charges based on chlorohydrocarbons, zinc powder and guanidine nitrate, possibly small quantities of other customary reaction-controlling agents, like those already discussed above in connection with the smoke charge based on chlorohydrocarbons and zinc powder. Such agents are for example powdered zinc, magnesium, aluminum, titanium or metal-oxide powders, like copper oxide or manganense dioxide. Further, such smoke charges can also contain slight amounts of customary oxygen-supplying compounds, like potassium nitrate or barium nitrate, as reaction-controlling agents. An especially preferred pyrotechnic smoke charge based on red phosphorus contains about 60 wt.% red phosphorus and about 40 wt.% quanidine nitrate.

A portion of the red phosphorus in smoke charges of this type can also be replaced by a chlorohydrocarbon, e.g. hexachloroethane, and such a smoke charge contains, for example, 66 wt.% red phosphorus, 40 wt.% guanidine nitrate and 4 wt.% hexachloroethane.

The smoke charges of the invention are set off with the customary ignition charges.

The invention will be illustrated further by means of the following examples.

EXAMPLE 1

Smoke Charge Based on Hexachloroethane and Zinc Powder

To form a smoke charge the following components are thoroughly mixed together:
34 wt.% hexachloroethane,
22 wt.% zinc powder,
8 wt.% zinc oxide,
36 wt.% guanidine nitrate.

EXAMPLE 2

Smoke Charge Based on Red Phosphorus

To form a smoke charge based on red phosphorus one mixes the following components thoroughly:
60 wt.% red phosphorus and
40 wt.% guanidine nitrate.

EXAMPLE 3

Smoke Charge Based on Red Phosphorus

The following components are thoroughly mixed with one another:
56 wt.% red phosphorus
40 wt.% guanidine nitrate,
4 wt.% hexachloroethane.

What is claimed as new and desired to be secured by Letters Patent of the United States is:

1. A pyrotechnic smoke charge which comprises guanidine nitrate and
(a) chlorohydrocarbons and a metal powder or
(b) red phosphorus, which can be partially replaced by a chlorohydrocarbon, and wherein said charge may optionally contain a small amount of a reaction regulating agent.

2. A smoke charge as in claim 1, wherein the amount of chlorohydrocarbon in (a) for the formation of metal chloride from the metal present, ranges from about the stoichiometrically required amount up to about a 15% excess.

3. A smoke charge as in claim 1, wherein the amount of guanidine nitrate in (a) constitutes at least about one mole to three chlorine atoms of the chlorohydrocarbon.

4. A smoke charge of any of claims 1,2 or 3, which contains about 34 wt.% hexachloroethane, about 22 wt.% zinc powder, about 8 wt.% zinc oxide and about 36 wt.% quanidine nitrate.

5. A smoke charge as in claim 1, wherein in (b) it contains red phosphorus and about 30 to 50 wt.% guanidine nitrate.

6. A smoke charge as in claim 5, which contains red phosphorus and about 35 to 45 wt.% guanidine nitrate.

7. A smoke charge as in claim 5, which contains about 60 wt.% of red phosphorus and about 40 wt.% guanidine nitrate.

8. A smoke charge of any of claims 5, 6 or 7, which contains up to about 25 wt.% of a customary binder.

9. The pyrotechnic smoke charge of claim 1, wherein said chlorohydrocarbon is selected from the group consisting of saturated aliphatic chlorohydrocarbons and aromatic chlorohydrocarbons.

10. The pyrotechnic smoke charge of claim 1, wherein said chlorohydrocarbon is selected from the group consisting of dichloromethane, carbontetrachloride, trichloroethylene, tetrachloroethane, hexachloroethane, pentachlorobenzene, and hexachlorobenzene.

11. The pyrotechnic smoke charge of claim 1, wherein said metal powder is selected from the group consisting of zinc powder, aluminum powder, titanium powder and silicon powder.

12. The pyrotechnic smoke charge of claim 11, wherein said zinc powder is replaced by a metal oxide powder selected from the group consisting of zinc oxide, copper oxide, iron oxide, manganese dioxide, and titanium dioxide.

* * * * *

UNITED STATES PATENT AND TRADEMARK OFFICE

CERTIFICATE OF CORRECTION

PATENT NO. : 4,238,254

DATED : December 9, 1980

INVENTOR(S) : Georg Prahauser et al.

It is certified that error appears in the above—identified patent and that said Letters Patent is hereby corrected as shown below:

Column 1, line 47, "dinitroresorcinal" should read -- dinitroresorcinol --, and "of" should read -- as --.

Signed and Sealed this

*Twenty-first* Day of *July 1981*

[SEAL]

*Attest:*

GERALD J. MOSSINGHOFF

*Attesting Officer*

*Commissioner of Patents and Trademarks*